US005857405A

United States Patent [19]

Bischof

[11] Patent Number: 5,857,405

[45] **Date of Patent: *Jan. 12, 1999**

[54] APPARATUS AND METHOD FOR SEPARATING SOLID MATTER FROM A LIQUID

[75] Inventor: Rudolf Bischof, Eching, Germany

[73] Assignee: Spirac Engineering Aktiebolag, Malmo, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 702,730

[22] PCT Filed: Mar. 3, 1995

[86] PCT No.: PCT/SE95/00223

§ 371 Date: Nov. 26, 1996

§ 102(e) Date: Nov. 26, 1996

[87] PCT Pub. No.: WO95/24306

PCT Pub. Date: Sep. 14, 1995

[30] Foreign Application Priority Data

Mar. 7, 1994 [DE] Germany ..... P4407525.1

[51] Int. Cl.[6] ..... B30B 9/14

[52] U.S. Cl. ..... 100/37; 100/117; 100/127; 100/145

[58] Field of Search ..... 100/117, 126, 100/127, 145, 37; 210/162

[56] References Cited

U.S. PATENT DOCUMENTS

| | | | |
|---|---|---|---|
| 3,319,897 | 5/1967 | Craig et al. | 100/117 |
| 4,212,239 | 7/1980 | Fraula et al. | 100/117 |
| 4,859,322 | 8/1989 | Huber | 210/162 |
| 5,078,865 | 1/1992 | Huber | 210/162 |
| 5,110,461 | 5/1992 | Abel | 100/145 |

FOREIGN PATENT DOCUMENTS

| | | | |
|---|---|---|---|
| 0288105 | 10/1988 | European Pat. Off. . | |
| 3939880 | 6/1990 | Germany . | |
| 548403 | 9/1956 | Italy | 100/117 |
| 1430592 | 3/1976 | United Kingdom | 100/117 |
| 93/01000 | 1/1993 | WIPO . | |

OTHER PUBLICATIONS

Patent Abstracts of Japan, vol. 15, No. 85, m–1087, abstract of JP,A,2–303699 (Fujitsu General Ltd), Dec. 17, 1990.

*Primary Examiner*—Stephen F. Gerrity
*Attorney, Agent, or Firm*—Ladas & Parry

[57] ABSTRACT

An apparatus for separating solid matter from a liquid has a rotatably driven conveyor spiral with one end projecting into a container, such as a gutter, in which a liquid containing solids flows. The spiral conveyor conveys the liquid from the container into a surrounding screen jacket so that liquid escapes from the jacket while the solids continue to be conveyed by the spiral. The spiral conveys the solids into a hollow, cylindrical jacket in which is supported a rotatable shaft drivingly connected to the conveyor spiral and extending longitudinally therefrom. The shaft and hollow, cylindrical jacket form a compression zone and the hollow, cylindrical jacket has a lateral opening through which the solids are conveyed to an outlet device extending laterally from the opening for discharge of the solids to a transport container, a sack filling machine or the like.

18 Claims, 2 Drawing Sheets

APPARATUS AND METHOD FOR SEPARATING SOLID MATTER FROM A LIQUID

FIELD OF THE INVENTION

The present invention relates to an apparatus for separating solid matter from a liquid which contains solid matter, the apparatus having a rotatably driven conveyor spiral or the like which, at least in part regions, is disposed in a screen casing or jacket which corresponds to the outer contour of the conveyor spiral or the like, and which, with one end protrudes into a container filled with liquid, for example a gutter and which, at its opposing end, displays a discharger via which the discharged solid matter may be supplied to a transport container, a sack filling machine or the like.

BACKGROUND AND PRIOR ART

Apparatuses of this type are known in the art. For example, screen screws with integrated screening presses are already known in the art. A conveyor spiral or helix is, in such instance, disposed in a cylindrical screen jacket which, with its one end, terminates in a gutter in which flows a liquid carrying solid matter, the solid matter being separated from the liquid by means of the screen casing or jacket and being removed via the conveyor spiral. This known screen screw features a drive motor disposed at that end opposite the channel and by means of which the conveyor spiral is driven. A press for screenings is disposed between the end of the conveyor spiral and the drive motor and is provided with a downstream discharger.

Consequently, this prior art screening screw with integrated press for screenings is disposed in a gutter which is subject to through flow by waste water. In this instance, the screen surface retains floating and semi-suspended matter, as well as heavier matter in the waste water, these matter fractions being discharged by the conveyor spiral in connection with the screen surface. To this end, the conveyor spiral is disposed at an angle which slopes relative to the horizontal, whereby the conveyor spiral, at that end which is opposite the gutter, reaches a predetermined height in relation to ground level. This makes it possible to dispose a receptacle container or a sack filling machine under the downwardly directed discharger. The discharged solid matter can be taken care of by means of the receptacle container or sack filler machine, i.e. further transport may be put into effect. Discharge of the solid matter which is compressed in the screening press takes place in that the continuously supplied solid matter reaches a pressure in the screening press, whereby the solid matter fractions which are disposed in the region of the discharger are pressed out and, by force of gravity, fall down into the sack filling machine, transport or landfill container.

One disadvantage inherent in this prior art apparatus is that, as a result of a limited angle of inclination for the conveyor spiral, a long conveyor path is required in order to achieve sufficient height for the discharger so as to make possible the provision of the sack filling machine or suitable receptacle containers, respectively, beneath the discharger. As a result, these apparatuses, because of their longitudinal extent, take up considerable space, for which reason such apparatuses may only be disposed in correspondingly dimensioned buildings.

SUMMARY OF THE INVENTION

Using this state of the art as a point of departure, the object of the present invention is to improve an apparatus of this type so that it features a shorter construction length and, at the same time, makes for improved discharge of solid matter, laterally or upwardly.

The solution to this problem is obtained for an apparatus of this type, in that a rotatably driven discharge device is disposed in the end region of the spiral conveyor path, or precisely after this path, in order to discharge the solid matter laterally, i.e. substantially tangentially to the transport spiral. The discharge device consists of a substantially cylindrical shaft and at least one discharge element radially disposed thereto, by means of which the solid matter which is compressed in the compression zone is substantially conveyed radially to the conveyor spiral.

An apparatus designed according to this concept has the advantage that, at almost any desired position in the spiral conveyor path, removal of solid matter may take place—this preferably being directed to the side or also upwardly in the region of the compression zone. This realizes a space-saving arrangement of the entire apparatus and, in particular, expensive building costs may be saved. This is achieved in that a discharge of the solid matter may take place laterally at a low height seen from ground level. To this end, the discharge element acts in the form of a paddle which forces out the solid matter which has been compressed in the compression zone from the conveyor spiral, for example via a laterally disposed discharger. However, it is also conceivable according to the present invention that two diametrically opposed paddles can be provided on the cylindrically formed shaft, which makes it possible to achieve an increase in discharge capacity. However, a lower degree of compression and thereby dewatering of the solid matter will thereby be achieved, since the time during which the solid matter remains in the compression zone is shortened.

According to yet a further characterizing feature of the present invention, the arrangement is such that the discharge element is flat-shaped with a substantially triangular cross section. According to still a further characterizing feature of the present invention, the discharge element is preferably disposed substantially parallel with the longitudinal axis of the shaft. It has proved that, with this arrangement, it is possible to achieve particularly high discharge capacities in connection with a satisfactory compression and dewatering of the solid matter.

A further improvement of discharge capacity—as well as compression capacity—is achieved in a simple manner in that the sum total of the radius of the shaft and the radial height of the discharge element corresponds to half of the inner diameter of the hollow cylindrical jacket. As a result of this design ratio, the advantage will moreover be attained that the discharge element simultaneously acts for cleaning the inner surface of the hollow cylindrical jacket, in that the discharge element, in this version, lies with its edge facing away from the shaft against the surface of the hollow cylindrical jacket and consequently acts as a type of scraper blade which entrains solid matter adhering to the inner surface of the hollow cylindrical jacket, this solid matter being conveyed to the discharger. Finally, it is appropriate in this embodiment that the discharge element extends into the discharger, which is automatically formed by a surface section of the hollow cylindrical jacket.

A further improvement to the apparatus according to the present invention will be attained in that an outlet device is disposed in the region of the discharger, the outlet device running substantially tangentially to the hollow cylindrical jacket and, according to yet a further characterizing feature of the present invention, consisting, for example, of a pipe section. This outlet device serves to move the solid matter forced out from the compression zone by the discharge element to, for example, a sack filling machine which may be provided at the end of the outlet device. In addition, the outlet device may be designed to run at an angle to the hollow cylindrical jacket of the conveyor spiral, whereby a directed discharge of the solid matter, for example upwardly or to the side, is made possible in a simple manner.

According to yet a further characterizing feature of the present invention, the arrangement is such that the shaft extends at least into the region of the upper end of the conveyor spiral. As a result of this design, there will particularly be achieved an improvement of the compression effect in the compression zone because the spiral is connected to the shaft, whereby a defined compression space is formed which consists of an annular space between the shaft and the inner surface of the hollow cylindrical jacket. The solid matter which is conveyed via the spiral is automatically forced into this space. In such instance, it has proved to be particularly advantageous that the conveyor spiral is connected to the shaft, preferably welded, and that the conveyor spiral and the shaft are driven at the same speed and in the same direction by drive means. First, there will hereby be obtained an economically favorable design and construction since only one drive motor and drive transmission are required, and secondly the design and construction which are formed by the connection between the shaft and the conveyor spiral is extremely stable, whereby the torque of the drive motor may be transferred from the shaft to the conveyor spiral without difficulty.

A good dewatering of the discharged solid matter is obtained in that the conveyor spiral is designed as a screen spiral. Consequently, the liquid which carries the solid matter is able to run off not only via the screen jacket but also via the screen spiral, which is advantageous particularly in the region of the transition from the conveyor spiral in the compression zone when the shaft extends at least into the final thread of the conveyor spiral, since otherwise the liquid forced out can only run off in limited quantities from the compression zone.

Alternatively, the apparatus according to the present invention may be arranged such that the shaft passes through the conveyor spiral throughout its entire length, whereby the shaft will, in practice, form the core of the conveyor spiral.

Finally, according to still a further characterizing feature of the present invention, the arrangement is such that the discharge element extends into the region of the last thread of the conveyor spiral.

BRIEF DESCRIPTION OF THE DRAWINGS

Further features and advantages will be apparent from the following description, with accompanying drawings, in which one preferred embodiment of the apparatus according to the present invention is shown. In the accompanying drawings.

DETAILED DESCRIPTION

Figure 1:
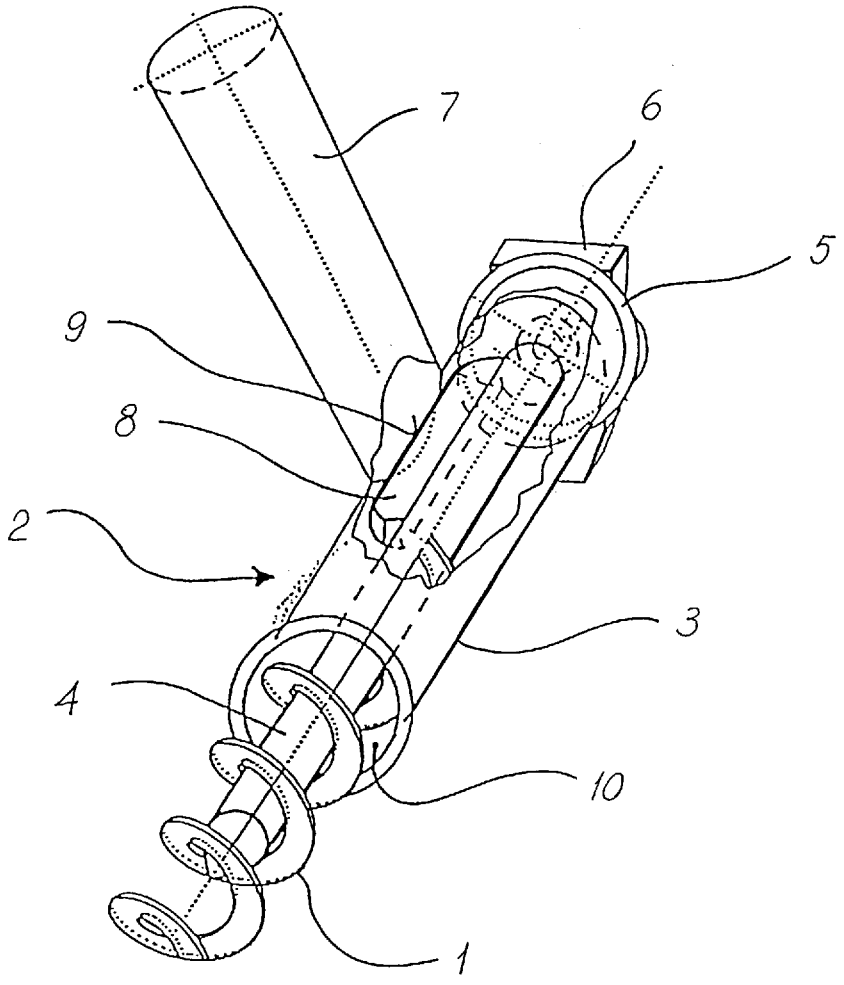
FIG. 1 is a perspective view, broken away and with parts removed for ease of illustration, of the upper end of a rotary, driven conveyor spiral with a compression zone.
Figure 2:
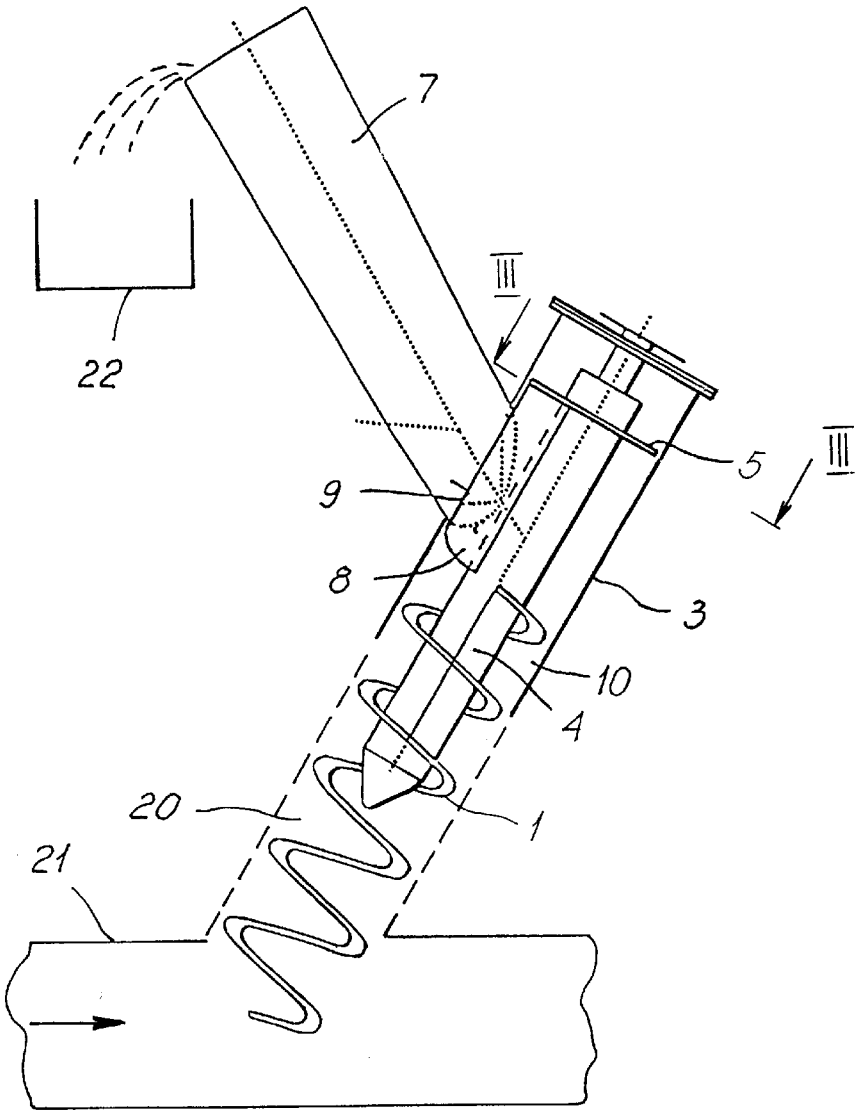
FIG. 2 is a side elevation view of the rotary driven conveyor spiral view with the compression zone according to FIG. 1.

FIG. 1 shows the upper end of an apparatus for separating solid matter from a liquid carrying solid matter. The apparatus includes a rotary 30 driven conveyor spiral or helix 1 which, as seen in FIG. 2 is disposed in a screen jacket 20 corresponding to the outer contour of the conveyor spiral 1 which further projects with one end into a container filled with liquid, namely a gutter or channel 21. The channel 21 holds liquid carrying solid matter, in which event the solid matter may be separated from the liquid via the screen jacket 20 and be discharged via the conveyor spiral 1.

FIG. 1 shows the upper end of the apparatus which has a compression zone 2 consisting of a hollow cylindrical jacket 3 in whose inner space a rotatably driven discharge device 4 in the form of a cylindrically designed shaft is disposed. Consequently, a compression zone is formed between the inner surface of the hollow cylindrical jacket 3 and the outer surface of the discharge device 4, in which space the discharged solid matter is conveyed via the conveyor spiral 1 and is pressed against an end plate 5 defining the compression zone 2. Hereby, the solid matter is compressed and dewatered.

The conveyor spiral 1 is welded to the discharge device 4 formed as a shaft, the conveyor spiral 1 and the discharge device 4 being driven at the same speed and in the same direction by common drive means 6. The drive means 6 is disposed on the end of the apparatus at the discharge side and consists of a drive motor and flanged-connected transmission. The drive shaft of the transmission passes through the end plate 5 and is non-rotatably connected to the discharge device 4 designed as a shaft.

In its hollow cylindrical jacket 3, the compression zone 2 has a laterally disposed outlet opening which is designed as a surface section of the hollow cylindrical jacket 3 and on which is secured an outlet device 7 in the form of a pipe section. Via this outlet device 7, the solid matter forced out through the discharge opening is conveyed, for example, to a sack filling machine 22 or other arrangement for taking care of the dewatered, solid matter. The outlet device 7 may, in this instance, be disposed at an angle to the longitudinal axis of the conveyor spiral 1 and discharge device 4, respectively.

Figure 3:
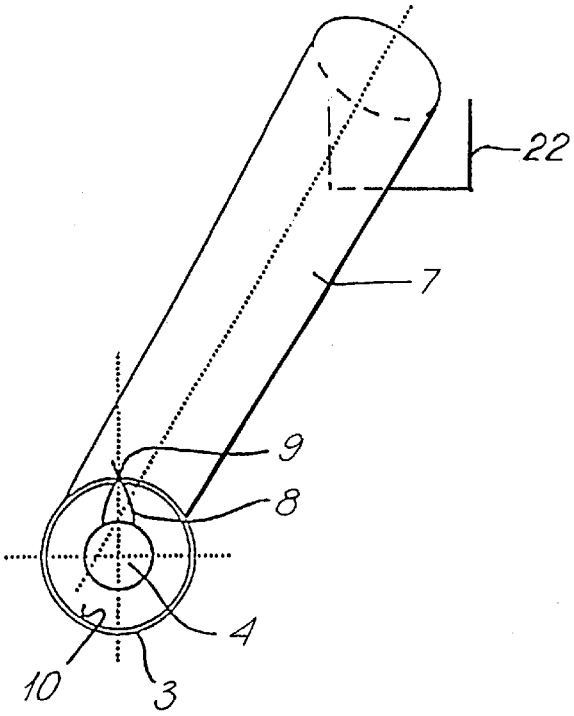
FIG. 3 is a view of the compression zone according to FIG. 2 taken along the line III—III in FIG. 2.

In addition, the discharge device 4 has a radially disposed discharge element 8 by means of which the solid matter compressed in the compression zone 2 is conveyed or moved out, respectively, in a direction towards the outlet device 7 substantially radially in relation to the conveyor spiral 1 and the discharge device 4, respectively. The discharge element 8 is designed to be plate-like and is substantially of triangular cross section, as is particularly apparent from FIG. 3. With this discharge element 8, for each rotation of the discharge device 4, a portion of the solid matter disposed in the compression zone 2 is displaced via the discharge opening into the discharge device 7 from which the solid matter is, for example via a sack filling machine, filled into sacks and thereafter conveyed off. However, it is also conceivable according to the present invention that the solid matter can be transported to a landfill deposit by means of continuous conveyance.

As is particularly apparent from FIG. 2, the discharge element is disposed parallel with the longitudinal axis of the discharge device 4 designed as a shaft, the sum total of the radius of the shaft and the radial height of the discharge element 8 corresponds to half of the inner diameter of the hollow cylindrical jacket 3. In such instance, the discharge element 8 abuts against the inner surface 10 of the hollow cylindrical jacket 3 with its edge facing away from the discharge element 4, and scrapes off the solid matter accumulated there, conveying it in a direction towards the outlet device 7.

It will be particularly apparent from FIG. 2 that the discharge device 4 designed as a shaft extends into the region of the upper end of the conveyor spiral 1, and that the discharge element 8 is disposed between the end plate 5 and the final thread of the conveyor spiral 1, whereby the discharge element 8 extends through practically the entire length of the compression zone 2.

With the paddle-shaped discharge element 8 disposed in the discharge region of the discharge device 4, it will thus be achieved that the material which is to be conveyed (i.e. the solid matter) is led off at the end of the conveyor path in the region of the compression zone 2 and is forced aside, transversely relative to the original direction of transport of the conveyor spiral 1. Via the connected outlet device 7 (which, for example, may also be designed as a pipe conduit or shaft system), the material may be displaced several metres without any further positive driving. The transverse conveyance of the solid matter can, in such instance, take place at an angle of 90°, but also at an acute or obtuse angle relative to the longitudinal axis of the conveyor spiral 1. Consequently, not only a horizontal but also upward or downward direction of displacement are possible, whereby, in approximately the same displacement service in filling installations for sacks, containers or the like, the space of the extent of the channel or plane in which the conveyor path conveys may be utilized. This provides an excellent possibility of guiding the solid matter in respect of its movement in space.

What is claimed is:

1. An apparatus for separating solid matter from a liquid comprising:

a rotatably driven conveyor spiral having one end projecting into a container containing liquid from which solids in the liquid are to be removed, said conveyor spiral conveying the solids out of the liquid in the container, a screen jacket surrounding the conveyor spiral to allow escape of the liquid while the solids are conveyed by the conveyor spiral, a rotatably driven cylindrical shaft drivingly connected to said conveyor spiral and extending longitudinally therefrom, a hollow, cylindrical jacket surrounding said shaft and receiving the solids from said screen jacket by the conveyor spiral, said hollow, cylindrical jacket and said rotatably driven cylindrical shaft defining a compression zone in which the solids are compressed, an outlet device connected to said hollow cylindrical jacket at said compression zone and extending laterally from said hollow, cylindrical jacket to receive and convey compressed solids from said compression zone, and a radially disposed plate-shaped discharge element on said shaft in said compression zone to move the solids radially to said outlet device.

2. The apparatus as claimed in claim 1, wherein said plate-shaped element has a substantially triangular cross section.

3. The apparatus as claimed in claim 1, wherein said discharge element extends substantially longitudinally in parallel with said cylindrical shaft.

4. The apparatus as claimed in claim 1, wherein said hollow cylindrical jacket has an inner diameter, said cylindrical shaft has a radius and said discharge element has a radial height, the sum of the radius of the shaft and the radial height of the discharge element corresponding to substantially one-half the inner diameter of the hollow, cylindrical jacket.

5. The apparatus as claimed in claim 1, wherein said outlet device extends tangentially from said hollow, cylindrical jacket.

6. The apparatus as claimed in claim 1, wherein said outlet device comprises a pipe section.

7. The apparatus as claimed in claim 1, wherein said shaft extends into an upper end of said conveyor spiral.

8. The apparatus as claimed in claim 1, comprising a drive means for driving said shaft and said conveyor spiral together.

9. The apparatus as claimed in claim 1, wherein said conveyor spiral comprises a screen spiral.

10. The apparatus as claimed in claim 1, wherein said conveyor spiral has an end thread which adjoins said discharge element.

11. The apparatus as claimed in claim 1, wherein said conveyor spiral extends upwardly from said container containing the liquid and solids.

12. The apparatus as claimed in claim 1, wherein said hollow cylindrical jacket has a side wall with an opening therein, said outlet device being connected to said hollow cylindrical jacket at said opening therein.

13. The apparatus as claimed in claim 12, wherein said hollow, cylindrical jacket is closed at one end of said compression zone by an end plate remote from said conveyor spiral, said apparatus further comprising a drive means outside said end plate and drivingly connected to said shaft.

14. The apparatus as claimed in claim 1, wherein said conveyor spiral comprises a hollow, spiral member having one end welded to said shaft and extending axially from said shaft with a hollow, central region in prolongation of said shaft, said shaft extending partially into said screen jacket, said shaft having a free, lower end disposed in said screen jacket to which said one end of the hollow spiral member is welded.

15. The apparatus as claimed in claim 1, wherein said hollow cylindrical jacket has a side wall with an opening therein, said outlet device comprising a pipe section connected to said hollow cylindrical jacket at said opening therein, said pipe section extending upwardly from said jacket and having an upper end from which said solids are discharged.

16. An method for separating solid matter from a liquid comprising:

immersing one end of a rotatably driven conveyor spiral into a container containing liquid from which solids in the liquid are to be removed, conveying the solids out of the container, while allowing liquid accompanying the solids to escape through a screen jacket, advancing said solids by a rotatably driven cylindrical screw shaft drivingly connected to said conveyor spiral and extending longitudinally therefrom, feeding said solids into a hollow, cylindrical jacket surrounding said screw shaft, compressing said solids in a compression zone defined by said hollow, cylindrical jacket and said rotatably driven cylindrical said shaft, discharging the compressed solids in said compression zone to an outlet device connected to said hollow cylindrical jacket at said compression zone and extending laterally from said hollow, cylindrical jacket, and moving said solids radially in said compression zone for discharge to said outlet device by a radially disposed plate-shaped element on said shaft in said compression zone.

17. A method as claimed in claim 16, comprising conveying said solids from said compression zone upwardly in said outlet device and discharging said solids from an upper end of said outlet device.

18. A method as claimed in claim 17, comprising conveying said solids tangentially from said hollow, cylindrical jacket into said outlet device and then upwardly in said outlet device.

* * * * *